US012808553B2

(12) United States Patent
Schechner et al.

(10) Patent No.: US 12,808,553 B2
(45) Date of Patent: Nov. 24, 2026

(54) OUTDOOR ENERGY-STORAGE DEVICE WITH EXHAUST AIR CONNECTION

(71) Applicant: Envola GmbH, Ulm (DE)

(72) Inventors: Alexander Schechner, Ulm (DE); Gerhard Ihle, Ulm (DE); Guenther Schwenk, Heidenheim (DE)

(73) Assignee: Envola GmbH, Ulm (DE)

( * ) Notice: Subject to any disclaimer, the term of this patent is extended or adjusted under 35 U.S.C. 154(b) by 195 days.

(21) Appl. No.: 18/577,727

(22) PCT Filed: Jul. 15, 2022

(86) PCT No.: PCT/EP2022/069919
§ 371 (c)(1),
(2) Date: Jan. 9, 2024

(87) PCT Pub. No.: WO2023/285684
PCT Pub. Date: Jan. 19, 2023

(65) Prior Publication Data

US 2024/0318839 A1 Sep. 26, 2024

(30) Foreign Application Priority Data

Jul. 16, 2021 (DE) ..... 10 2021 118 417.7

(51) Int. Cl.
*F24F 1/46* (2011.01)
*F24F 1/48* (2011.01)
(Continued)

(52) U.S. Cl.
CPC ..... *F24F 1/46* (2013.01); *F24F 1/48* (2013.01); *F24F 1/66* (2013.01); *F24F 2005/0025* (2013.01)

(58) Field of Classification Search
CPC ..... F24F 1/46; F24F 1/48; F24F 1/66; F24F 1/00077; F24F 2005/0025; F24F 12/003;
(Continued)

(56) References Cited

U.S. PATENT DOCUMENTS 2,241,060 A * 5/1941 Gibson ..... F25B 13/00 236/1 C
2,808,494 A * 10/1957 Telkes ..... F24H 7/04 23/300
(Continued)

FOREIGN PATENT DOCUMENTS

DE 103 21 646 A1 7/2004
DE 10 2020 119 653 B3 7/2021
EP 2 450 641 A2 5/2012

OTHER PUBLICATIONS

International Search Report in PCT/EP2022/069919, mailed Oct. 28, 2022.

*Primary Examiner* — Travis Ruby
(74) *Attorney, Agent, or Firm* — Collard & Roe, P.C.

(57) ABSTRACT

An outdoor energy-storage device of a system for air conditioning interior rooms of a building can be arranged outside the building and partially sunken in the ground. The outdoor-energy storage device includes an energy store for energy transmission and energy storage with a liquid reservoir, a water heat exchanger in the liquid reservoir and an air heat exchanger above the liquid reservoir. The outdoor-energy storage device further includes a heat pump which is coupled to the water heat exchanger and the air heat exchanger and an exhaust-air connection which is intended for exhaust air from the building and is coupled to the energy store and the heat pump so that the exhaust air entering through the exhaust-air connection adjusts the temperature
(Continued)

Figure 1:
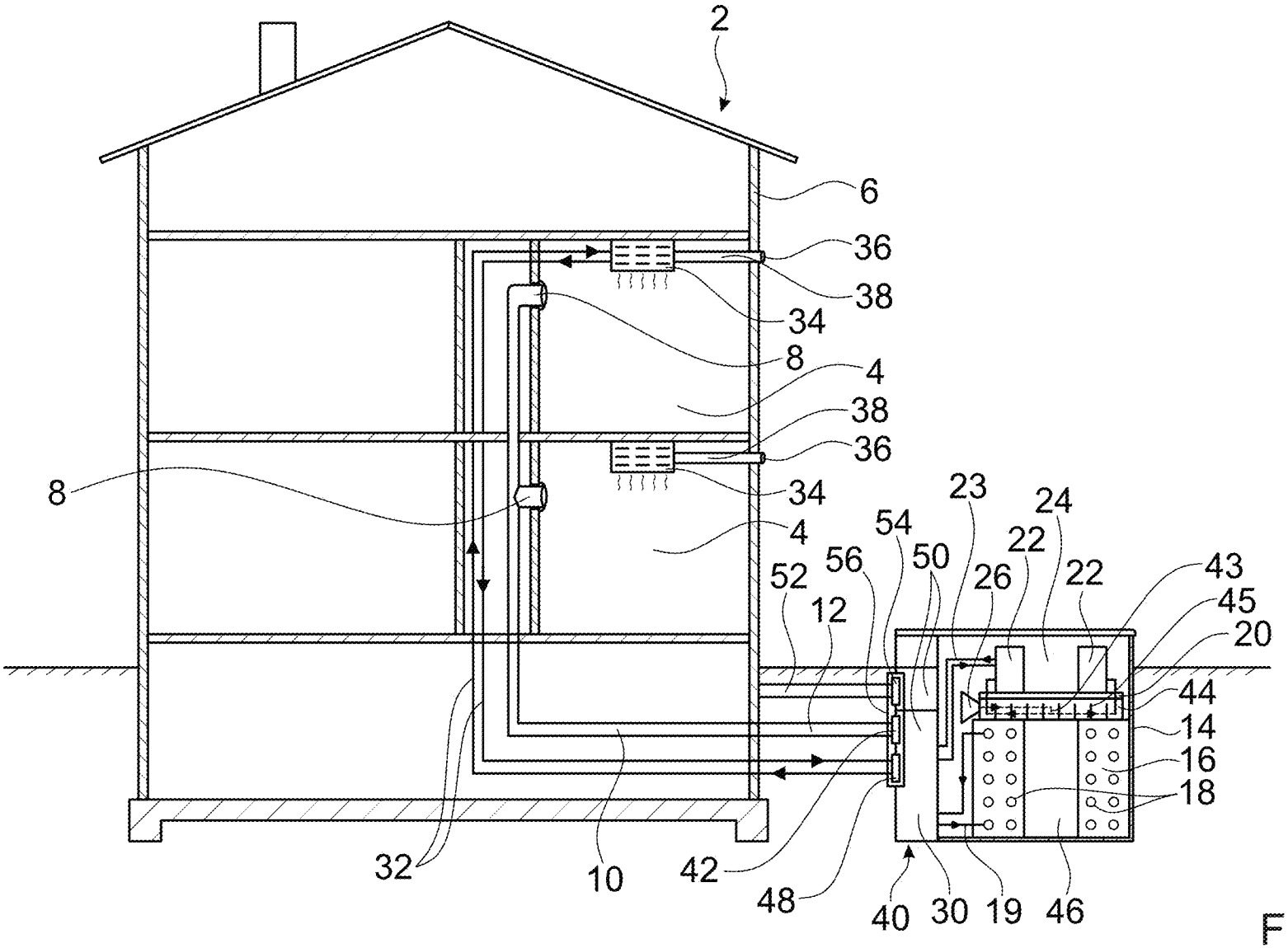

of the heat pump, at least in certain regions, before the exhaust air enters the energy store.

11 Claims, 3 Drawing Sheets

(51) Int. Cl.
*F24F 1/66* (2011.01)
*F24F 5/00* (2006.01)

(58) Field of Classification Search
CPC ..... F24F 12/001; F28D 20/0034; F28D 2020/0078; F28D 2020/0082; F28D 21/0003; F28D 21/0014
See application file for complete search history.

(56) References Cited

U.S. PATENT DOCUMENTS 4,139,055 A * 2/1979 Thomason ..... F28D 20/0034 237/19
4,196,719 A * 4/1980 Skrivseth ..... F24D 11/006 126/400
4,237,859 A * 12/1980 Goettl ..... F24F 5/0046 126/400
4,307,778 A * 12/1981 Tobin ..... F24F 1/50 165/125
4,350,200 A * 9/1982 McElwain ..... F24D 11/0221 126/633
4,434,004 A * 2/1984 Ratschat ..... F28D 15/0275 266/139
4,452,229 A * 6/1984 Powers ..... F28D 20/0056 126/400
4,632,180 A * 12/1986 Lauderdale ..... F28F 1/003 237/19
5,181,552 A * 1/1993 Eiermann ..... F24F 3/153 62/176.5
5,318,101 A * 6/1994 Kim ..... F24F 5/0017 165/122
5,485,879 A * 1/1996 Lannes ..... F28F 9/0132 122/15.1
5,493,871 A * 2/1996 Eiermann ..... F24F 3/153 62/90
5,736,059 A * 4/1998 Mackelvie ..... F24D 17/001 165/47
7,549,418 B1 * 6/2009 Moorman ..... F24F 5/0096 126/633
7,934,543 B2 5/2011 Fieback et al.
9,016,358 B2 4/2015 Fieback et al.
2007/0266722 A1 * 11/2007 McCaughan ..... F24T 10/10 165/45
2009/0000577 A1 * 1/2009 Miyagawa ..... F01N 5/02 123/41.2
2009/0277444 A1 * 11/2009 Lin ..... F24S 60/30 126/643
2011/0079024 A1 * 4/2011 Hakbijl ..... F24F 1/0007 62/160
2011/0100587 A1 * 5/2011 Yang ..... F28D 20/0052 165/45
2011/0113777 A1 * 5/2011 De Amicis ..... F28D 20/0034 220/565
2011/0303396 A1 * 12/2011 Ishida ..... F24F 1/16 165/121
2011/0308265 A1 * 12/2011 Phannavong ..... F24F 11/84 62/160
2011/0314861 A1 * 12/2011 Kim ..... F24F 1/46 62/426
2014/0144919 A1 * 5/2014 Al-Dhafiri ..... F24H 1/182 220/592.2
2015/0159959 A1 * 6/2015 Petrovic ..... F01K 3/006 165/10
2017/0138610 A1 * 5/2017 Zammit ..... F28D 7/024
2018/0112930 A1 * 4/2018 Schechner ..... F03D 9/14
2018/0292097 A1 * 10/2018 Specter ..... F24S 20/20
2018/0356163 A1 * 12/2018 Schechner ..... F24V 50/00
2021/0071882 A1 * 3/2021 Devrath ..... F24F 1/50
2021/0131744 A1 * 5/2021 Grand ..... F28D 17/04
2021/0215438 A1 * 7/2021 Griffith ..... F24F 5/0046
2021/0239333 A1 * 8/2021 LePoudre ..... F24F 5/0035
2021/0341230 A1 * 11/2021 Ludlaim ..... F28D 15/0266
2022/0390126 A1 * 12/2022 Kazimirovich ..... F24F 12/003
2023/0266037 A1 8/2023 Schechner et al.
2023/0375281 A1 * 11/2023 Konowalczyk ..... F24D 19/1075
2024/0219065 A1 * 7/2024 Saeki ..... F24F 1/02
2025/0109912 A1 * 4/2025 Cooper ..... F28D 20/0056
2025/0129965 A1 * 4/2025 Lecoq ..... F24F 11/83

* cited by examiner

OUTDOOR ENERGY-STORAGE DEVICE WITH EXHAUST AIR CONNECTION

CROSS REFERENCE TO RELATED APPLICATIONS

This application is the National Stage of PCT/EP2022/069919 filed on Jul. 15, 2022, which claims priority under 35 U.S.C. § 119 of German Application No. 10 2021 118 417.7 filed on Jul. 16, 2021, the disclosure of which is incorporated by reference. The international application under PCT article 21(2) was not published in English.

The invention relates to an outdoor energy-storage device of a system for air conditioning interior rooms of a building. Such an outdoor energy-storage device is arranged outside the building and is at least partially sunken in the ground.

A system for air conditioning interior rooms of a building may comprise an energy store for energy transmission and energy storage with a water heat exchanger in a liquid reservoir. The liquid reservoir is arranged outside the building, whereas a heat pump for the water heat exchanger and the building is arranged inside the building. Further building services components, for example heating and hot water, are likewise arranged inside the building. Although the devices are easily accessible and protected inside the building, they still require a significant amount of space.

The object is to provide a space-saving device for an air conditioning system.

The object is achieved by an outdoor energy-storage device of a system for air conditioning interior rooms of a building. The outdoor energy-storage device can be arranged outside the building and can be partially sunken in the ground. The outdoor energy-storage device comprises an energy store for energy transmission and energy storage with a liquid reservoir, a water heat exchanger in the liquid reservoir and an air heat exchanger above the liquid reservoir, a heat pump, which is coupled to the water heat exchanger and the air heat exchanger, and an exhaust-air connection, which is intended for exhaust air from the building and is coupled to the energy store and the heat pump so that the exhaust air entering through the exhaust-air connection adjusts the temperature of the heat pump, at least in certain regions, before the exhaust air enters the energy store.

The outdoor energy-storage device is a compact outdoor device for the air conditioning system which can be installed sunken in the ground and can be delivered completely pre-installed as a unit and does not require any space inside the building. In contrast to conventional systems, in which only the energy store with its liquid reservoir is installed outside the house, further functional modules, in particular the water pump otherwise provided in the building, are relocated outside. The operation of the functional modules with cold-sensitive electrical circuits is insensitive to cold even at low outside temperatures in winter as a result of the exhaust air adjusting the temperature of the water pump and the optionally provided further functional modules, so that no heating needs to be provided in the outdoor energy-storage device. "Temperature adjustment" comprises in particular heating, but also cooling. Cooling is relevant during the hot summer.

In the energy store, the liquid reservoir allows energy to be stored in the liquid. Energy transfer in the energy store takes place both via the air heat exchanger and through the water heat exchanger. The exhaust air is the indoor air discharged from the building, the thermal energy of which is passed through the energy store for heat or cold recovery.

Prior to this, it serves for temperature adjustment, in particular for heating the functional modules in the outdoor energy-storage device, in order to enable reliable operation even at low outside temperatures.

In one embodiment, the heat pump is designed so that the exhaust air flows past it and/or flows through it to allow energy transfer between the exhaust air and the heat pump. The exhaust air serves in particular to adjust the temperature of an electrical circuit of the heat pump. The heat pump is designed as at least one functional module.

The same principle is used for adjusting the temperature of further functional modules, in particular for adjusting the temperature of their electrical circuits. The functional module forms a closed functional unit with usually its own housing within the outdoor energy-storage device. The functional modules are replaceable, which facilitates maintenance and repair. In the electrical circuit, electrical and/or electromechanical components are combined to form a functional arrangement which, for example, controls the functional module or its interaction with other functional modules, the energy store or other components of the system, which can also be buildings. Electrical circuits are sensitive to cold and are often the limiting factor for the operation of the functional module at low temperatures. Adjusting the temperature, in particular of the electrical circuits, therefore improves the operational reliability of the entire outdoor energy-storage device.

In one embodiment, the functional modules are designed such that waste heat from electrical components in the heat pump supports the temperature adjustment, so that not only the exhaust air is used for heating.

In one embodiment, one or more further stackable functional modules, which are advantageously designed to control heating, cooling and/or ventilation in the system, are provided. If a plurality of functional modules is provided, these are arranged such that the exhaust air flows between the functional modules to the energy store and the temperature of the functional modules is adjusted. The stackable functional modules allow a flexible and space-saving design of the outdoor energy-storage device. The functional scope can be flexibly designed by selecting the functional modules.

In one embodiment, there is a vertical gap between the functional modules through which the exhaust air can flow to the energy store. The gap directs the exhaust air to the energy store and at the same time guides the exhaust air past the functional modules. The gap is advantageously shaped such that it directs the exhaust air to an energy store inlet of the energy store through which the exhaust air enters the energy store. The shape of the gap can taper horizontally and in particular vertically toward the energy store inlet in order to concentrate the exhaust air, which may have adjusted the temperature of a plurality of stacked functional modules on both sides of the gap. Alternatively or additionally, the energy store inlet can be shaped and/or arranged such that it directs the flow behavior of the exhaust air.

In one embodiment, the outdoor energy-storage device comprises a base plate, a cover and a circumferential side wall between the base plate and the cover, which enclose the space in which the energy store and the functional modules are accommodated. The base plate can have a raised edge, which is associated with a trough shape. The outdoor energy-storage device can be installed at least partially sunken in the ground so that only the cover and the upper side wall protrude from the ground. They can be integrated into the design of the outdoor space, for example by adding greenery or providing a seat on the cover.

In one embodiment, the energy store has an exhaust air-conducting heat exchanger which is designed such that the exhaust air is directed via the liquid reservoir before it flows to the air heat exchanger in the energy store. In this way, energy is transferred between the exhaust air and the liquid in the liquid reservoir before the thermal energy of the exhaust air is used in the air heat exchanger.

In one embodiment, a cavity is arranged inside the liquid reservoir as a drinking or domestic hot water store, which offers an additional possible use. A water pump, which is designed as a functional module, is coupled to the cavity and allows drinking or domestic hot water to be supplied to the building, so that the drinking or domestic hot water is also stored and supplied outside the building.

Figure 2:
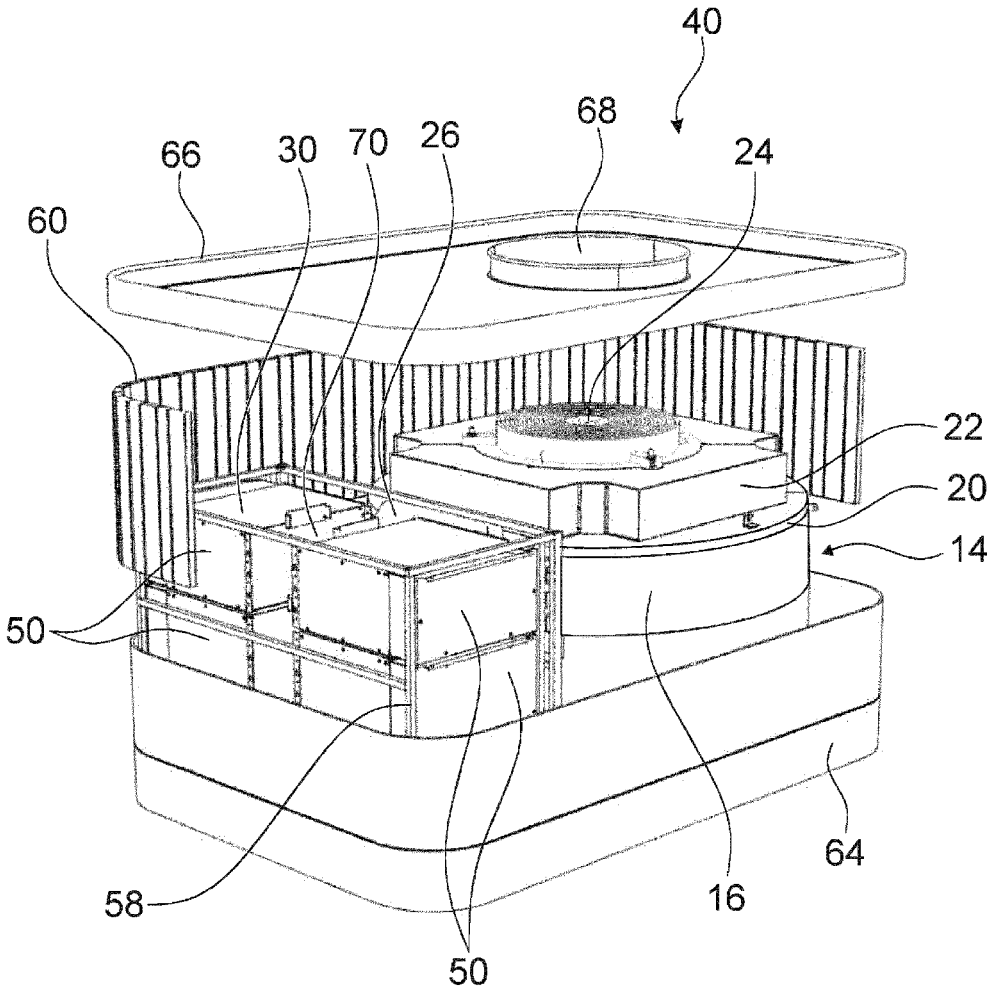
Figure 3:
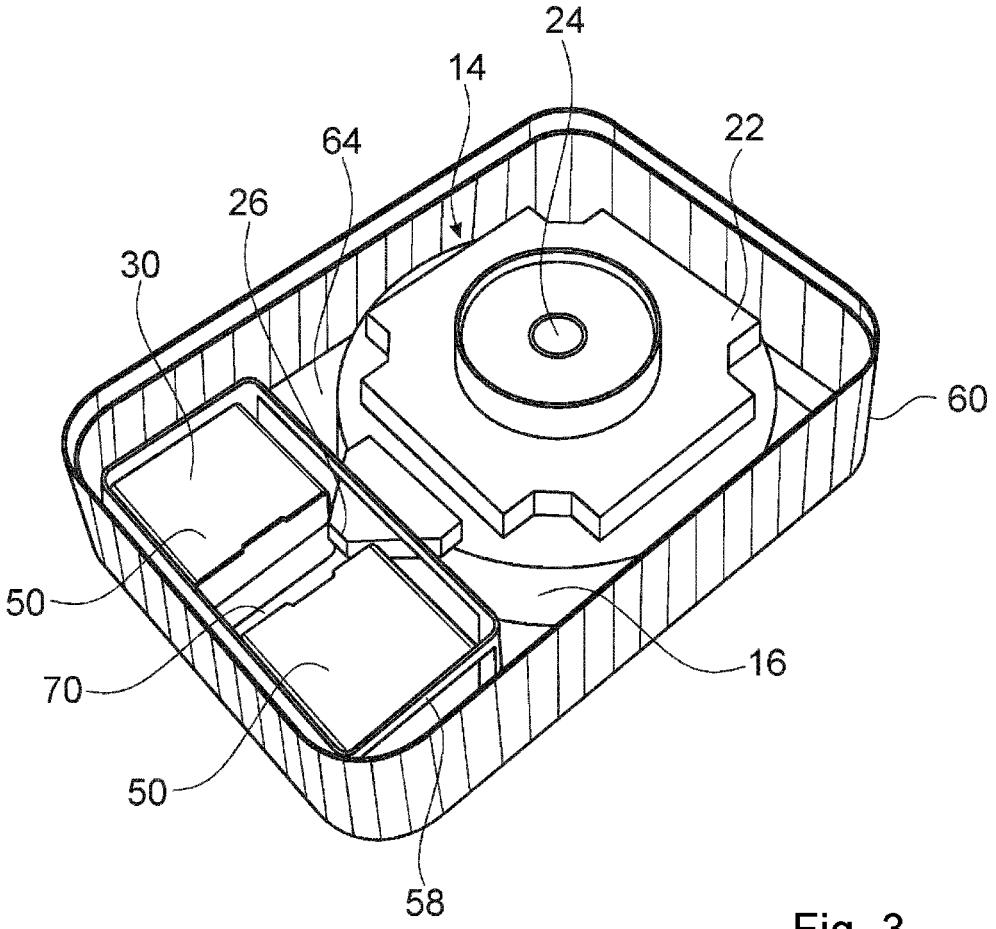

Some exemplary embodiments are explained in greater detail below with reference to the drawing. In the drawings:

FIG. 1 shows an embodiment of a system for air conditioning interior rooms of a building, FIG. 2 is a three-dimensional exploded view of an embodiment of an outdoor energy-storage device, and FIG. 3 is a three-dimensional view into the interior of the outdoor energy-storage device.

In the drawings, the same or functionally equivalent components are provided with the same reference signs.

An embodiment of a system 2 for air conditioning interior rooms 4 of a building 6 is shown in FIG. 1. The building 6 can be, for example, a residential building or office building. However, such a system 2 can be applied to different building types. The example shown should therefore be viewed as non-limiting. Each of the interior rooms 4 is connected via an exhaust-air opening 8 to an exhaust-air duct 10 which discharges exhaust air from the interior rooms 4.

The exhaust-air duct 10 is connected to an exhaust-air connection 42 of an outdoor energy-storage device 40 via a feed line 12. The outdoor energy-storage device 40 is arranged outside the building 6, for example in the garden or in an outdoor area, and is at least partially sunken in the ground so that only the upper region of the outdoor energy-storage device 40 protrudes from the ground.

The outdoor energy-storage device 40 has an energy store 14 with a water heat exchanger 18 in a liquid reservoir 16 and an air heat exchanger 22 above the liquid reservoir 16. The outdoor energy-storage device 40 also has a heat pump 30 as a functional module 50, which heat pump is coupled to the water heat exchanger 18 and the air heat exchanger 22. An exhaust-air connection 42 which is intended for exhaust air from the building 2 is coupled to the energy store 14 and the heat pump 30 such that the exhaust air entering through the exhaust-air connection 42 adjusts the temperature of the heat pump 30 before the exhaust air enters the energy store 14. From the exhaust-air connection 42 to the energy store 14, the exhaust air flows past or through the heat pump 30.

In its interior, the liquid reservoir 16 has a cavity 46 for storing drinking and/or domestic hot water, from which drinking and/or domestic hot water can be provided for the building 6. In this embodiment, the cavity 46 is designed as a cylinder and is laterally enclosed by the liquid reservoir 16, which is designed as a hollow cylinder. Alternative forms of the cavity 46, which is enclosed laterally and/or from above and/or from below by the liquid reservoir 16, are conceivable.

In the liquid reservoir 16 of the energy store 14, there is a water heat exchanger 18 with a plurality of pipes which are connected to the heat pump 30 via a water heat exchanger fluid circuit 19. A heat transfer medium flows through the pipes, discharging heat or cold transferred from the liquid in the liquid reservoir 16. Typically, the liquid reservoir 16 is filled with water or a paraffin compound.

Above the liquid reservoir 16, there is an air heat exchanger 22 above an insulating layer 20. The air heat exchanger 22 is arranged in a plurality of segments around a central region 24 of the energy store 14. A heat exchanger 44 with flow conductors 45 is arranged below the insulating layer 20. The heat exchanger 44 is designed such that an air flow 43 is directed via the liquid in the liquid reservoir 16 before the air 43 enters the air heat exchanger 22 in the energy store 14. The energy contained in the air flow 43 is thereby first supplied to the liquid reservoir 16. The heat exchanger 44 directs the air 43 radially outward via the liquid. The air 43 is then guided radially from the outside through the air heat exchanger 22. In the central region 24 there is a fan which sucks in the exhaust air 43 from the heat exchanger 44 with air flowing in radially from the outside toward the central region 24, where the air then leaves the energy store 14.

The heat pump 30 is connected to the fluid circuit 19 of the water heat exchanger 18. The heat pump 30 is likewise connected to a fluid circuit 23 of the air heat exchanger 18, which comprises a plurality of pipes. A heat transfer medium flows through the pipes, which heat transfer medium discharges heat or cold from the air flowing past the pipes. Two pump devices can be provided in the heat pump 30 for the water heat exchanger 18 and the air heat exchanger 22. A further fluid circuit 32 leads into the building 6 via a fluid connection 48 on the outdoor energy-storage device 40 and connects the heat pump 30 to an air conditioning unit 34 which, in addition to the connection to the further fluid circuit 32, has a supply of outside air via an opening 36 by means of the supply line 38.

Atwater pump which is coupled to the drinking and/or domestic hot water store is provided as a further functional module 50. It is designed to pump drinking and/or domestic hot water from the cavity 46 designed as drinking and/or domestic hot water store into the building 6. For this purpose, a drinking and/or domestic hot water connection 54 is provided on the outdoor energy-storage device 40, which is connected to a water line 52 leading into the building 6.

It is possible to provide further functional modules 50 for air-conditioning and building services in the outdoor energy-storage device 40. The connections provided for this purpose form an interface whose connections, like those already mentioned above, can be spatially combined into a main connection 56 to which the lines to the building 6 are connected. The main connection 56 can be connected to a functional module 50 designed as a main connection module. The main connection module controls the interface and its connections, as well as the coupling and communication of the other functional modules 50 internal to the outdoor energy-storage device.

FIG. 2 is a three-dimensional exploded view of an embodiment of an outdoor energy-storage device 40. It comprises a base plate 64, a cover 66 with a recess 68 for exhaust air discharge, and a circumferential side wall 60 between the base plate 64 and the cover 66. The side wall 60 is formed by a trough-shaped raised edge region of the base plate 64 and boards arranged above it which protrude at least partially from the ground. Fresh air can flow through the boards or openings provided for this purpose. The base plate 64 can be made of concrete, for example. It supports the energy store 14 and the functional modules 50, in particular for heating, cooling and ventilation of the building, including the heat pump 30 and the water pump. The trough shape of the base plate 64 protects the ground from possible leaking liquids. The cover 66 can be made of metal, for example. It protects the interior of the outdoor energy-storage device, but at the same time allows exhaust air to escape from the energy store 14 as outgoing air through the circular recess 68. When the outdoor energy-storage device 40 is mounted and sunken in the ground, the surface of the cover 66 can be integrated into the outdoor area design, for example by adding greenery and plants.

In addition to the energy store 14, functional modules 50 for heating, cooling and ventilating the building 6 are arranged in the outdoor energy-storage device 40. The functional modules 50 also comprise the heat pump 30 and water pump already described above. Further functional modules 50 can be provided for controlling heating or hot water supply.

The functional modules 50 are designed to be stackable and arranged next to one another in two stacks. For stabilization, a frame 58 is arranged on the base plate 64 in which the functional modules 50 are stacked and fastened. There is a gap 70 between the stacks through which exhaust air flows between the exhaust-air connection and the energy store 14, and thereby flows past the functional modules 50. The shape of the gap 70 can taper horizontally and in particular vertically toward an energy store inlet 26 of the energy store 14 which faces the gap 70 in order to concentrate the exhaust air, which has adjusted the temperature of a plurality of stacked functional modules on both sides of the gap 70, and to guide the exhaust air into the energy store inlet 26. Alternatively, other means may be provided for directing or concentrating the exhaust air on its way to the energy store inlet 26. The functional modules 50 can be designed such that at least a portion of the exhaust air flows through them, for example by providing air inlets and outlets in the housing of the functional module 50.

The gap 70 serves for heat recovery, since the exhaust air flowing through adjusts the temperature of the functional modules 50 before the exhaust air enters the energy store 14. Advantageously, the functional modules 50 are designed such that their cold-sensitive components, in particular electrical circuits, are arranged adjacent to the exhaust air flowing past. The cold-sensitive circuits are arranged on the sides facing the gap 70 in the functional modules 50. The heating is greater in the region of the exhaust air flowing past, so that it is advantageous to place the cold-sensitive components close to the exhaust air flowing past.

When it is cold outside, for example in winter, temperature adjustment through the exhaust air causes the functional modules 50 to be heated in order to increase their operational reliability and performance. The temperature-adjustment effect is supported by the waste heat from the electrical circuits in the functional modules 50, which also contribute to heating. There is no need to heat the outdoor energy-storage device 40. When it is warm outside, for example in summer, temperature adjustment causes the functional modules 50 to be cooled, as the cooler exhaust air also discharges heat from the electrical circuits.

FIG. 3 is a three-dimensional view into the interior of the outdoor energy-storage device 40 without a cover. The view corresponds to the outdoor energy-storage device 40 sunken in the ground, since only the above-ground region of the side wall 60 is shown, such that the underground interface is not visible. The rectangular gap 70 for heat recovery, through which the exhaust air flows between the stacked functional modules 50, is clearly visible. The funnel-shaped energy store inlet 26, through which the exhaust air enters the energy store 14, protrudes into the gap 70. The walls of the energy store inlet 26 protrude up to the corners of the functional modules 50, such that the exhaust air cannot flow past the energy store 14, but is directed into the energy store inlet 26. The upper functional modules 50 are the heat pump 30 and the main connection module.

The features indicated above and in the claims, as well as the features which can be seen in the figures, can advantageously be implemented both individually and in various combinations. The invention is not limited to the described exemplary embodiments, but can be modified in many ways within the scope of the capabilities of a person skilled in the art.

LIST OF REFERENCE SIGNS

2 System
4 Interior room
6 Building
8 Exhaust-air opening
10 Exhaust-air duct
12 Feed line
14 Energy store
16 Liquid reservoir
18 Water heat exchanger
19 Water heat exchanger fluid circuit
20 Insulating layer
22 Air heat exchanger
23 Air heat exchanger fluid circuit
24 Central region
15 26 Energy store inlet
30 Heat pump
32 Fluid circuit
34 Air conditioning unit
36 Opening
20 38 Supply line
40 Outdoor energy-storage device
42 Exhaust-air connection
43 Exhaust air flow
44 Heat exchanger
45 Flow conductors
46 Cavity
25 48 Fluid connection
50 Functional module
52 Water line
54 Drinking and/or domestic hot water connection
56 Main connection
30 58 Frame
60 Side wall
64 Base plate
66 Cover
68 Recess
70 Gap

The invention claimed is:

1. An outdoor energy-storage device of a system for air conditioning interior rooms of a building, wherein the outdoor energy-storage device is arranged outside the building and comprises:

an energy store for energy transmission and energy storage with a liquid reservoir, a water heat exchanger in the liquid reservoir and an air heat exchanger above the liquid reservoir, a first stackable functional module and a second stackable functional module spaced apart from the first stackable functional module, thereby forming a gap between the first stackable functional module and the second stackable functional module, a heat pump, which is configured to exchange thermal energy via the water heat exchanger and the air heat exchanger, wherein the heat pump is designed as a least one stackable functional module and the at least one stackable functional module comprises the first stackable functional module, and an exhaust-air connection, which is intended for exhaust air from the building and is coupled to the energy store and the heat pump so that the exhaust air entering through the exhaust-air connection flows from the exhaust-air connection to the energy store through the gap and past the heat pump before the exhaust air enters the energy store and thereby adjusts the temperature of the heat pump, at least in certain regions.

2. The outdoor energy-storage device according to claim 1, wherein the exhaust air flowing through the gap and past the heat pump adjusts the temperature of an electrical circuit of the heat pump.

3. The outdoor energy-storage device according to claim 2, wherein the heat pump is designed such that waste heat from the electrical circuit supports the temperature adjustment.

4. The outdoor energy-storage device according to claim 1, further comprising at least one further stackable functional module, which is designed to control heating, cooling and/or ventilation in the system, and the first stackable functional module, the second stackable functional module and the at least one further stackable functional module are arranged such that the exhaust air flows between the functional modules to the energy store and adjusts the temperature of the first stackable functional module, the second stackable functional module and the at least one further stackable functional module.

5. The outdoor energy-storage device according to claim 4, wherein the gap between the first stackable functional module and the second stackable functional module is a vertical gap through which the exhaust air can enter the energy store.

6. The outdoor energy-storage device according to claim 4, wherein the first stackable functional module and the second stackable functional module are designed such that waste heat from electrical circuits in the first stackable functional module and the second stackable functional module supports the temperature adjustment.

7. The outdoor energy-storage device according to claim 1, which further comprises a base plate, a cover and a circumferential side wall between the base plate and the cover.

8. The outdoor energy-storage device according to claim 1, wherein the energy store has an exhaust air-conducting heat exchanger, which is designed such that the exhaust air is guided to flow along an upper face of the liquid reservoir before the exhaust air flows to the air heat exchanger.

9. The outdoor energy-storage device according to claim 1, wherein a cavity designed as a drinking and/or domestic hot water store is arranged inside the liquid reservoir.

10. The outdoor energy-storage device according to claim 9, wherein a water pump designed as a functional module is coupled to the cavity.

11. The outdoor energy-storage device according to claim 1, wherein the outdoor energy-storage device is partially sunken in the ground.

* * * * *